US010138805B2

(12) United States Patent
Chen

(10) Patent No.: US 10,138,805 B2
(45) Date of Patent: Nov. 27, 2018

(54) SIX-STROKE AND EIGHT-STROKE INTERNAL COMBUSTION ENGINES

(71) Applicant: Chi Keng Chen, Fremont, CA (US)

(72) Inventor: Chi Keng Chen, Fremont, CA (US)

( * ) Notice: Subject to any disclaimer, the term of this patent is extended or adjusted under 35 U.S.C. 154(b) by 0 days.

(21) Appl. No.: 15/449,685

(22) Filed: Mar. 3, 2017

(65) Prior Publication Data

US 2018/0038275 A1 Feb. 8, 2018

(51) Int. Cl.
*F02B 75/02* (2006.01)
*F02B 69/06* (2006.01)

(52) U.S. Cl.
CPC ..... *F02B 75/021* (2013.01); *F02B 69/06* (2013.01)

(58) Field of Classification Search
CPC . F02B 75/021; F02B 69/06; F02B 2075/1832
See application file for complete search history.

(56) References Cited

U.S. PATENT DOCUMENTS 6,880,501 B2 * 4/2005 Suh ..... F02B 11/00 123/58.8
7,487,751 B2 * 2/2009 Baeuerle ..... F01L 1/08 123/321
9,284,892 B2 * 3/2016 Tsukahara ..... F02B 75/02
2007/0044778 A1 * 3/2007 Milovanovic ..... F02B 21/00 123/568.14
2009/0145382 A1 * 6/2009 Kawai ..... F01L 1/34 123/90.16
2010/0083921 A1 * 4/2010 Ooyama ..... F01L 1/38 123/64
2016/0032821 A1 * 2/2016 Dahlstrom ..... F02B 75/021 123/64
2016/0169125 A1 * 6/2016 Tsukahara ..... F01L 1/38 123/64
2016/0341117 A1 * 11/2016 Ekstrom ..... F02B 75/021

* cited by examiner

*Primary Examiner* — Long T Tran
(74) *Attorney, Agent, or Firm* — Shalini Venkatesh

(57) ABSTRACT

A method for improving the efficiency of an internal combustion engine having a cycle, for each cylinder of the engine, including intake, compression, power, and exhaust strokes, comprises inserting two strokes into the cycle in addition to the intake, compression, power, and exhaust strokes. No material other than air is introduced into each cylinder during either of the additional two strokes. A high efficiency internal combustion engine system having a cycle, for each cylinder of the engine, including intake, compression, power, and exhaust strokes, comprises a cylinder, a piston, an air intake device, a fuel injector, an exhaust valve device, a camshaft, and an electronic control unit (ECU) configured to control cylinder operation such that two strokes, in addition to the intake, compression, power, and exhaust strokes, are inserted into the cycle. No material other than air is introduced into each cylinder during either of the additional two strokes.

7 Claims, 6 Drawing Sheets

SIX-STROKE AND EIGHT-STROKE INTERNAL COMBUSTION ENGINES

CROSS REFERENCE TO RELATED APPLICATION

This application is related to U.S. patent application Ser. No. 13/276,226 entitled "Direct Gas Injection System for Four Stroke Internal Combustion Engine" filed on Oct. 18, 2011, and issued on May 7, 2013 as U.S. Pat. No. 8,434,462, which is hereby incorporated by reference, as if it is set forth in full in this specification.

FIELD OF THE INVENTION

Various embodiments of the invention described herein relate to the field of internal combustion engines for motor vehicles and, more particularly, to improved methods of operating such engines, and to the devices and components required to carry out these improved methods.

BACKGROUND OF THE INVENTION

The basic operational concepts of the internal combustion engine have remained largely unchanged for much of the past 130 years, since the patent issued to Karl Benz in 1886. Any improvement in the efficiency of internal combustion engines is highly desirable, on the grounds of direct and indirect costs to the user and to the environment.

Engine efficiency, defined as the work done per unit of fuel used, may be improved by addressing input or output aspects of the combustion process. One well known approach to address input aspects of the combustion process to improve efficiency in gasoline-fueled engines is the development of direct injection gasoline engines, in which the two functions of fuel introduction and air introduction into the engine cylinders are separated.

However, even when direct fuel injection is used with conventional four-stroke engines, whether gasoline or diesel-fueled, factors remain that significantly limit engine efficiency. One such factor is incomplete flushing of residual exhaust gas by the exhaust stroke, which results in undesirable dilution of the fuel/air mixture after the following intake and compression strokes. This in turn not only lowers the concentration of the newly introduced combustable gas mixture but also reduces the temperature of the mixture, both effects resulting in reducing the total energy generated from subsequent combustion. A second factor, which applies to direct injection gasoline engines but not to diesel engines, is incomplete mixing of the fuel/air mixture in the cylinder before the compression stroke, the resulting spatial non-uniformity of the mixture creating obvious problems in achieving repeatable, predictable combustion. Variations of +/−10% in the combustion energy conversion from chemical to thermal energy are typical, forcing sub-optimal choices of both ignition timing and the amount of fuel required to be injected. In practice, to ensure that the fuel-poor regions within the cylinder will still experience combustion, significantly more fuel is introduced than would be necessary if it could be assumed that the fuel would be uniformly distributed throughout the cylinder space before ignition.

There is therefore a need for methods and systems to improve the efficiency of internal combustion engines by addressing the problems of incomplete flushing (common to both direct fuel-injected gasoline engines and diesel engines) and of incomplete mixing (present in gasoline engines). Such methods and systems would ideally require relatively small changes to engine design and operation, the direct and indirect costs of those changes being outweighed by an accompanying increase in the efficiency of fuel usage.

SUMMARY OF THE INVENTION

The present invention includes a method for improving the efficiency of an internal combustion engine having a cycle, for each cylinder of the engine, including intake, compression, power, and exhaust strokes. In one aspect of the invention, the method comprises inserting two strokes into the cycle in addition to the intake, compression, power, and exhaust strokes; wherein no material other than air is introduced into each cylinder during either of the additional two strokes. The two additional strokes may occur at a time in the cycle for each cylinder after the end of the exhaust stroke, and before the intake stroke of an immediately subsequent cycle.

In another aspect of the invention, the method for improving the efficiency of an internal combustion engine having a cycle, for each cylinder of the engine, including intake, compression, power, and exhaust strokes, comprises inserting four strokes into the cycle in addition to the intake, compression, power, and exhaust strokes; wherein no material other than air is introduced into each cylinder during either of the additional four strokes. Two of the four additional strokes may occur at a time in the cycle for each cylinder after the end of the exhaust stroke, and before the intake stroke of an immediately subsequent cycle; and two others of the four additional strokes may occur at a time in the cycle for each cylinder after the end of the compression stroke, before combustion occurs, and before the power and exhaust strokes of the cycle.

DETAILED DESCRIPTION

The manner in which the present invention provides its advantages over current internal combustion engines can be more easily understood with reference to FIGS. 1 through 5. For simplicity, only one representative cylinder 102 is shown in FIGS. 1 through 4, and the detail of valves opening and closing are omitted.

Figure 1:
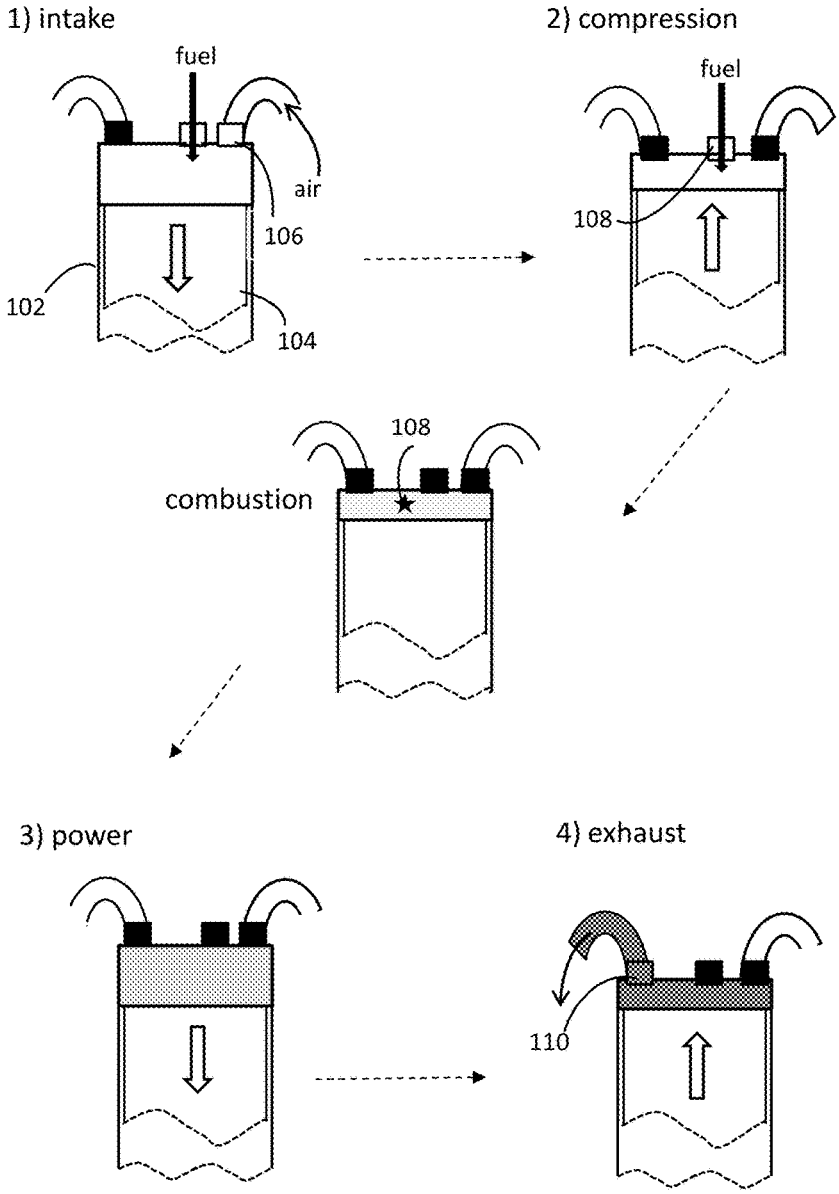
Figure 1 (Prior Art)
FIG. 1 schematically illustrates the operation of a prior art gasoline-fueled internal combustion engine using direct fuel injection.

FIG. 1 schematically illustrates the operation of a prior art 4-stroke internal combustion engine that uses gasoline direct injection (GDI). During the intake stroke, labeled 1) at the top left of the figure, piston 104 moves down within cylinder 102, drawing air into the cylinder through air intake device 106. As this is a GDI engine, instead of the gasoline being introduced along with the air through device 106, it is injected into cylinder 104 through fuel injector 108. In the compression stroke, labeled 2) at the top right of the figure, the fuel/air mixture in the cylinder gets compressed as piston 104 moves up. More fuel may (optionally) be injected during this compression stroke. At the end of the compression stroke, combustion occurs when a spark 110 is introduced to ignite the mixture, as indicated in the center of the figure. The combustion process generates power in the power stroke, labelled 3) at the bottom left of the figure, forcing piston 104 down. Finally, in the exhaust stroke, labelled 4) at the bottom right of the figure, piston 104 moves up, pushing the exhaust gases out of the cylinder through exhaust valve device 112. Note that even at the end of the exhaust stroke, cylinder 102 will not be completely emptied. As discussed in detail in U.S. Pat. No. 8,434,462, noted above, due to back pressure, a small volume of residual gases (mainly oxygen-depleted air and combustion-generated impurities) will remain present, and will mix with air and fuel taken in in subsequent strokes of subsequent cycles. The residual gases absorb heat without participating in useful combustion, seriously limiting the fuel efficiency achieved by the engine, especially under partial load conditions, where waste gas forms a correspondingly larger portion of the volume in the cylinder before combustion.

Figure 2:
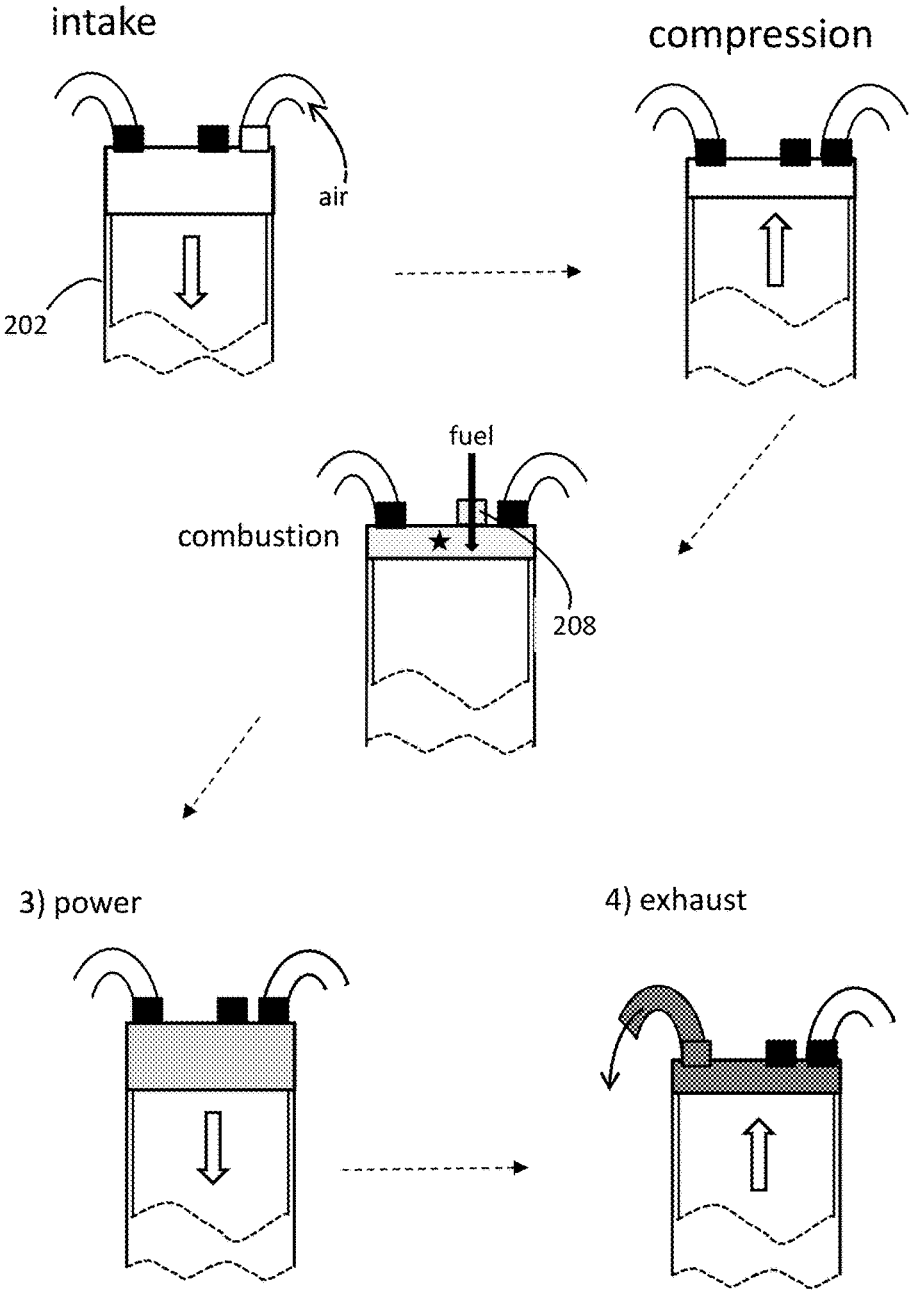
Figure 2 (Prior Art)
FIG. 2 schematically illustrates the operation of a prior art diesel-fueled internal combustion engine.

FIG. 2 schematically illustrates the operation of a prior art 4-stroke internal combustion engine that uses diesel rather than gasoline. During the intake stroke (shown top left) only air is introduced into cylinder 202. At the end of the compression stroke (shown top right) diesel is introduced through fuel injector 208. On encountering the highly compressed, hot air, ignition of the diesel/air mixture occurs spontaneously without the need for any introduced spark. The star symbol in the figure is simply indicative of combustion. Power and exhaust strokes happen in the same way as in the GDI engine of FIG. 1, with the same problem of residual gases remaining in the cylinder after the exhaust stroke.

Figure 3:
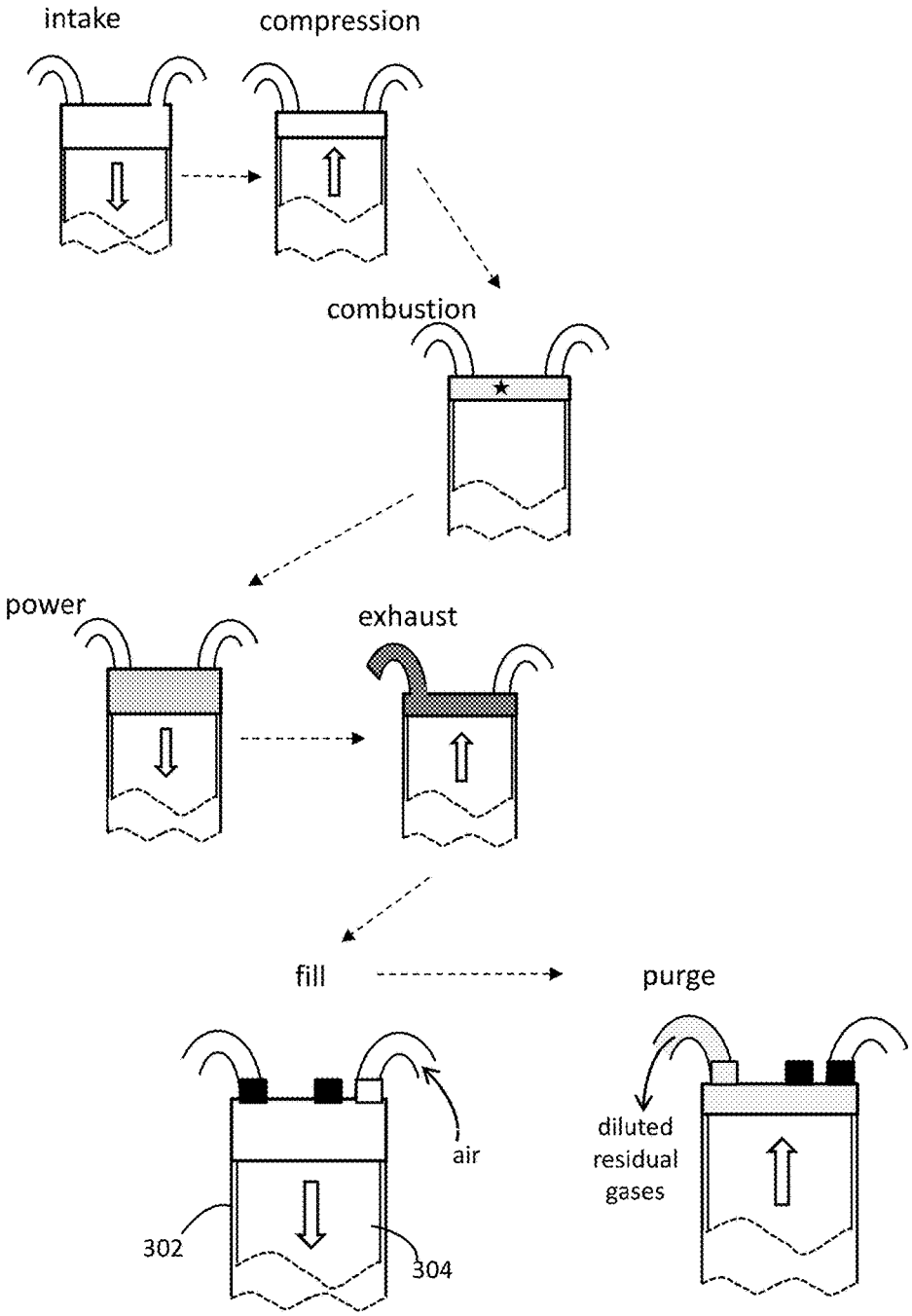
FIG. 3 schematically illustrates the operation of an internal combustion including two additional strokes according to one embodiment.

FIG. 3 schematically illustrates the operation of an internal combustion including two additional strokes according to one embodiment of the present invention. This six-stroke embodiment addresses the issue of residual gases, mentioned above. The first four strokes of the cycle occur just as described above with respect to FIGS. 1 and 2, comprising intake, compression, power and exhaust strokes. The timing of the fuel injection and the method of creating ignition differ between gasoline and diesel engines as discussed above, but the details are not significant for the purpose of understanding the present invention, and therefore are not shown explicitly.

After the completion of the exhaust stroke, shown roughly in the center of the figure, two additional strokes occur. The first of these additional strokes is a "fill" or additional air intake stroke, during which air is drawn into cylinder 302 as piston 304 moves down. This additional air serves to dilute the residual gas mixture (oxygen-depleted air and combustion-generated impurities) remaining in the cylinder after the exhaust stroke. No fuel is introduced during this stroke. Next, a "purge" stroke occurs, during which piston 304 moves up and pushes the diluted mixture out of cylinder 302. Although the cylinder will not empty completely, due to back pressure as noted above and discussed in related U.S. Pat. No. 8,434,462, the volume of the oxygen-depleted air and combustion-generated impurities remaining at the end of the purge stroke will be greatly reduced by the operation of the fill and purge strokes. The subsequent air intake stroke of the subsequent cycle will therefore result in a correspondingly diluted mixture, which will in turn result in more efficient combustion and power generation during that cycle.

Standard 4-stroke gasoline engines typically use compression ratios of 10:1, which causes a drop in efficiency, relative to the maximum theoretically possible if all the residual gases could be expelled, of about 10%. Engines designed and operated according to the embodiment shown in FIG. 3 could almost wipe out that differential, with the burning of the fuel air mixture generating higher temperatures and higher pressures, which will produce more mechanical work for the same amount of fuel burned. In other words, the fuel efficiency of such a six-stroke embodiment would be expected to be about 10% greater than the corresponding four-stroke engine. Diesel engines typically use compression ratios of 20:1, so the expected improvement in efficiency of the embodiment of FIG. 3 would be correspondingly less, but still significant at about 5%.

The only change required to the structure of the engine to achieve these savings is a redesigned camshaft drive, with suitable new lobes to open and close the required valves appropriately to achieve the desired stroke operation. One drawback of increasing the number of strokes per cycle is the creation of additional frictional losses, which include direct mechanical losses directly proportional to engine rpm, and the pumping loss, due to driving the piston against the pressure gradient in the fill stroke (the fifth in the sequence shown in FIG. 3). Obviously, the frictional loss must be minimized if the anticipated efficiency improvements of the six-stroke stroke engine is to be realized, and this can be achieved when the engine is run at low speed and as close as possible to the full load condition (when the throttle is fully open).

Figure 4:
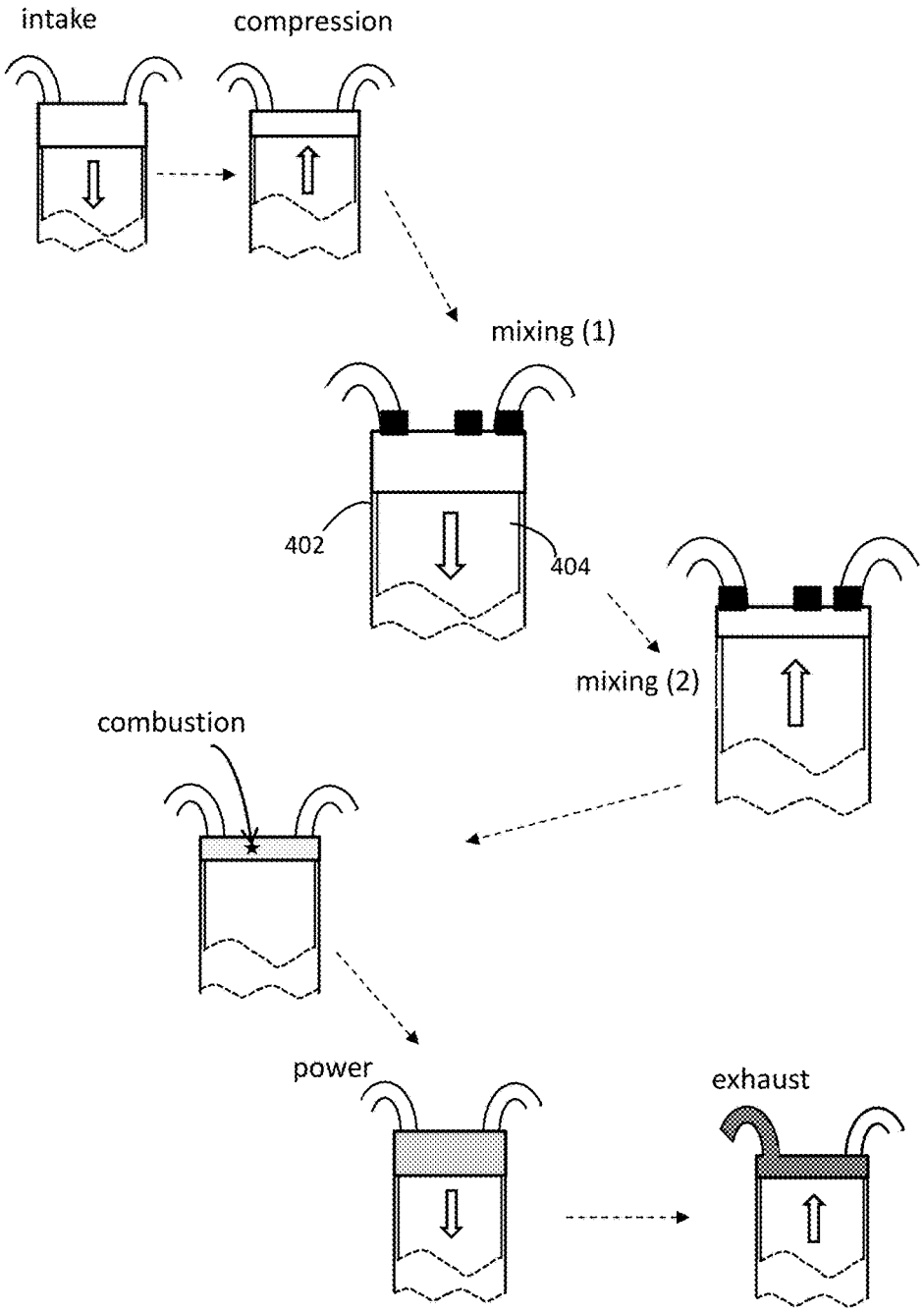
FIG. 4 schematically illustrates the operation of an internal combustion including two additional strokes according to another embodiment.

FIG. 4 schematically illustrates the operation of an internal combustion including two additional strokes according to another embodiment of the present invention. This six-stroke embodiment addresses the issue of non-uniformity of the fuel/air mixture, mentioned above. In a standard four-stroke engine, as shown in FIG. 1, the turbulent mixing of the fuel and air that occurs during the intake and compression strokes is insufficient to ensure an even composition; some regions will be much "richer" in fuel than other "fuel-poor" regions. Therefore, when a spark is introduced to ignite the mixture into combustion, there can be no certainty as to whether it will encounter a fuel-rich or fuel-poor region. Statistical considerations govern the mixing and combustion processes. In order to increase the likelihood that combustion occurs properly, avoiding misfiring and drivability issues, more fuel is introduced during the intake (and optionally compression) strokes that should be needed according to strict stoichiometry of the chemical reactions involved. The extra fuel ensures that even the fuel-poor regions will have enough fuel for combustion to occur, but this is obviously wasteful of fuel, and reduces engine efficiency. Furthermore, the non-uniformity of the mixture remains present, meaning that the spark timing advance (the fraction of the cycle before maximum compression that the spark is introduced) cannot be ideal for all regions within the cylinder, being optimized for an "average" value. The energy extracted from the fuel/air mixture will be correspondingly reduced from the ideal, by 10% or more.

In the embodiment of FIG. 4, the first two strokes of the cycle occur just as described above with respect to FIGS. 1 and 2, comprising intake and compression strokes. However, two additional mixing strokes are then introduced, during which no air or fuel is allowed into or out of the cylinder.

During the first of these additional strokes, labelled "mixing (1)" in the figure, piston 404 moves down to the bottom of cylinder 402, and during the second of these additional strokes, labelled "mixing (2)" in the figure, piston 404 moves up towards the top of the cylinder. At the appropriate time, typically 20 degrees before piston 404 reaches Top Dead Center, a spark is introduced initiating combustion, and power and exhaust strokes occur as normal. The additional mixing strokes of this embodiment serve to more evenly distribute the air taken in during the first, intake stroke, and the fuel injected during the first and possible the second, compression stroke, throughout the cylinder space. The uniformity of the resulting mixture before combustion is initiated means that significantly less fuel has to be injected to ensure proper combustion. It may be possible to operate the engine with an extremely lean mixture, having a fuel to air ratio of 0.7. This intrinsically improves efficiency by using less fuel, and has an additional advantage regarding air pollution, in reducing the production of CO and NOx combustion byproducts.

The spark timing advance can also be optimized to operate on the entire mixture with greater efficiency, and reduced cycle-to-cycle variations.

Similar considerations of reducing frictional losses discussed above with respect to the six-stroke embodiment of FIG. 3 apply to the six-stroke embodiment of FIG. 4, although in the FIG. 4 case, a small amount of additional energy may be expended in the mixing (2) stroke, driving piston 404 up within an effectively "sealed" cylinder.

Standard four-stroke diesel engines do not have the problem of non-uniformity of the fuel/air mixture, as the diesel is sprayed into the highly-compressed hot air and ignition occurs spontaneously, without needing the introduction of a spark. The six-stroke embodiment of FIG. 4 therefore is not advantageous to diesel engines. However, the six-stroke embodiment of FIG. 3 applied to a diesel engine is anticipated to achieve a figure of merit for fuel efficiency of less than 170 g of diesel per kw-hour of energy production.

Two six-stroke embodiments have been described above, one of which addresses the problem of residual gas management common to both gasoline and diesel engines with direct injection, and the other of which addresses the problem of non-uniformity of the fuel/air mixture in gasoline engines with direct injection.

In theory, each of these approaches could be extended by adding additional pairs of stroke. For example, after carrying out one fill stroke and one purge stroke, one or more pairs of fill and purge strokes could be carried out before the cycle closes and a new intake stroke is performed. Similarly, instead of just one pair of mixing strokes before combustion, two or more pairs of mixing strokes may be carried out. Diminishing returns will occur at some point, where the additional frictional losses begin to outweigh the efficiency gains.

In the case of gasoline engines with direct injection, embodiments that use the two additional strokes of the FIG. 3 embodiment as well as the two additional strokes of the FIG. 4 embodiment may easily be envisaged. In such an eight-stroke embodiment, the two initial strokes (intake and compression) would be followed by two mixing strokes, before spark introduction and combustion occur. Next, after the power and exhaust strokes are performed, a fill stroke and a purge stroke would be carried out. This embodiment would benefit from the efficiency improvements of both approaches, regarding residual gas management and fuel/air mixture non-uniformity. It is anticipated that a figure of merit of below 200 grams of gasoline per kw-hr of energy production may be achieved.

Figure 5:
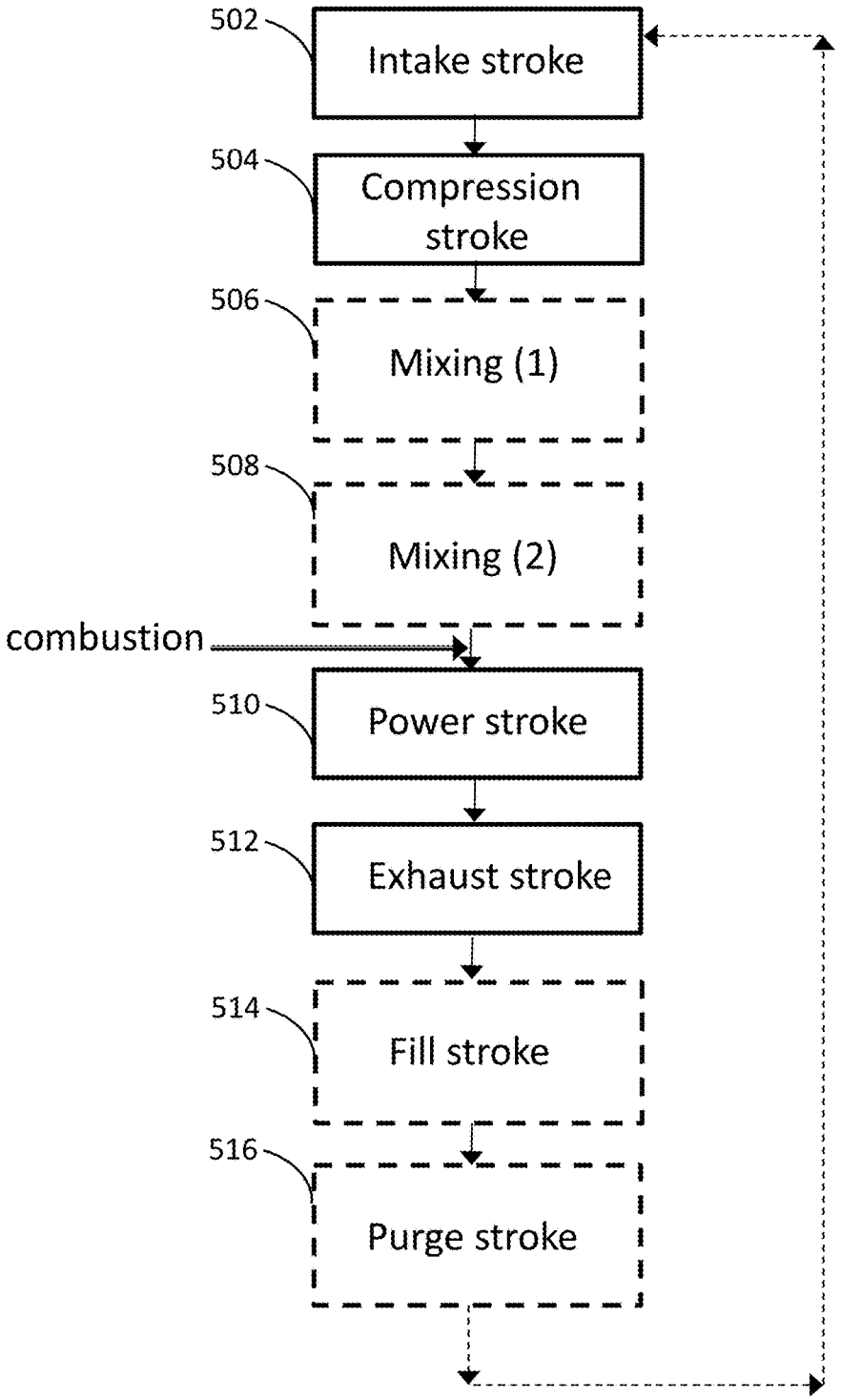
FIG. 5 is a flowchart illustrating the inclusion of two or four additional strokes into the internal combustion engine cycle, according to some embodiments.

FIG. 5 is a flowchart illustrating the inclusion of two or four additional strokes into the internal combustion engine cycle. In an eight-stroke embodiment, all the steps 502 through 516 would be carried out, from step 502 (intake), through step 504 (compression), step 506 (mixing (1)), step 508 (mixing (2)), step 510 (power), step 512 (exhaust), step 514 (fill), and step 516 (purge). As noted above, this sequence would be useful for gasoline engines employing direct injection. However, some embodiments may omit either steps 506 and 508, or steps 514 and 516. Each of these six-stroke embodiments would still provide significant engine efficiency improvements over current practice. Embodiments relevant to a diesel engine employing direct injection would omit mixing steps 506 and 508 but include fill and purge steps 514 and 516.

Figure 6:
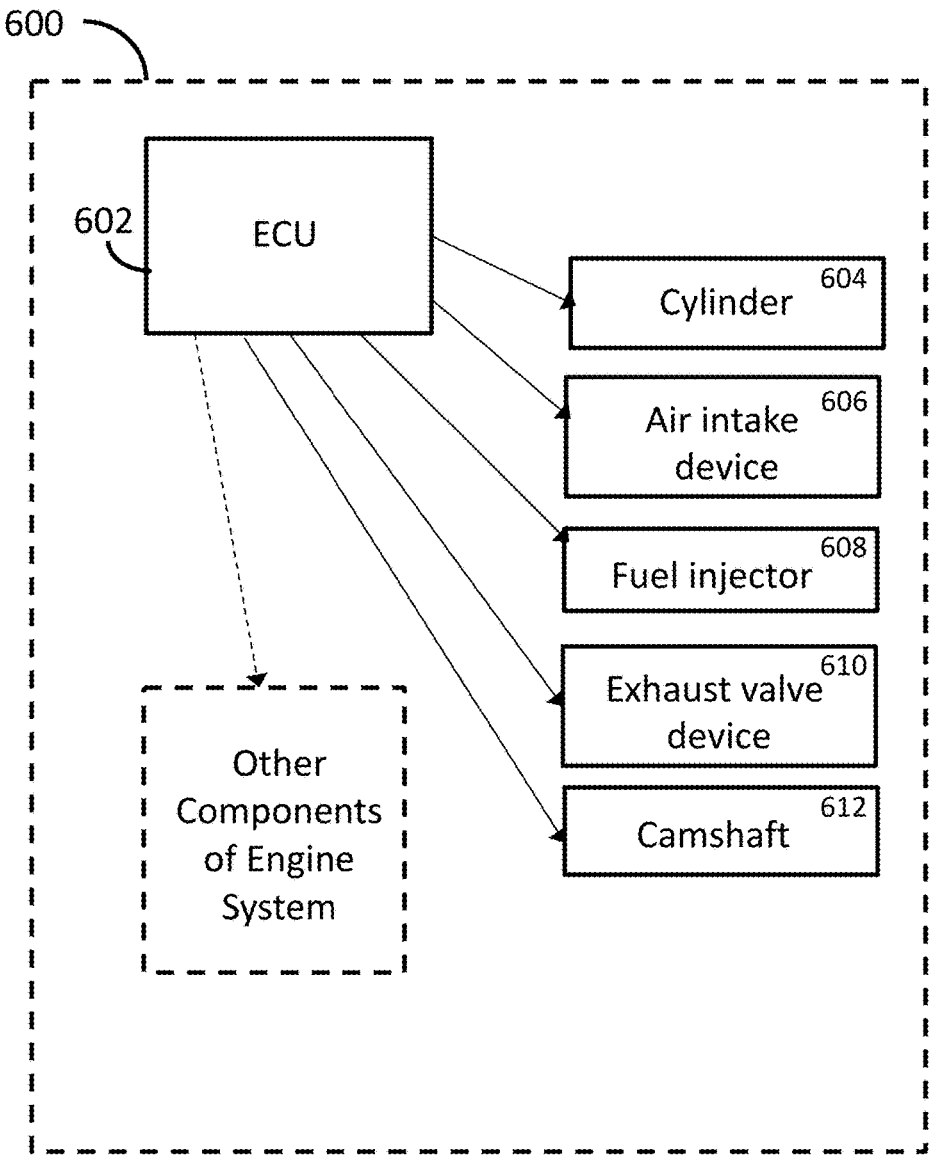
FIG. 6 is a schematic diagram showing components of a high efficiency internal combustion engine system, according to some embodiments.

FIG. 6 is a schematic block diagram showing components of a high efficiency internal combustion engine system, according to some embodiments of the present invention. System 600 includes cylinder 604, air intake device 606, fuel injector 608, exhaust valve device 610, camshaft 612, and electronic control unit (ECU) 602. ECU 602 is operatively connected to each of components 604, 606, 608, 610, and 612, and is configured to control the operation of the air intake device, the fuel injector, the exhaust valve device and the camshaft, such that two strokes, in addition to the intake, compression, power, and exhaust strokes, are inserted into each combustion cycle for cylinder 604. No material other than air is introduced into each cylinder during either of the additional two strokes. ECU 602 may also be connected to various other components of engine system 600, to control other aspects of engine operation than those of primary interest to the present invention. In embodiments of the present invention, ECU 602 operates to insert additional strokes into the cycle as described above with regard to FIGS. 3, 4, and 5, achieving the efficiency improvements also as discussed above.

Embodiments of the present invention have applications including but not limited to automobiles. They may, for example, be used in emergency power supplies, in power sources in remote locations such as forest ranger stations, in military systems on land or on ships and submarines, and in locomotives, whether diesel or gasoline-fueled. These are all applications where the improved efficiency provided by the present invention could be very beneficial. Another advantage of the present invention is reduced air pollution, due to more complete combustion of the fuel used, as well as reduced fuel usage.

The present invention may be applied to other engines beyond standard four-stroke engines of the prior art. For example, a gasoline engine that already employs the residual gas expelling system described in U.S. Pat. No. 8,434,462, referenced above, would not require the full and purge strokes of the the embodiment of FIG. 3, but could benefit significantly from the addition of the mixing strokes of the embodiment of FIG. 4, improving efficiency still further. Turbo-charged engine systems could also benefit by incorporating some of the ideas described herein, but handling the two hot and cold exhaust outputs and adjusting the inter-exhaust pulse period would involve some complex redesign.

The above-described embodiments should be considered as examples of the present invention, rather than as limiting the scope of the invention. Various modifications of the above-described embodiments of the present invention will become apparent to those skilled in the art from the foregoing description and accompanying drawings. Note further that included within the scope of the present invention are methods of making and having made the various components, devices and systems described herein.

Accordingly, the present invention is to be limited solely by the scope of the following claims.

The invention claimed is:

1. A method for improving the efficiency of an internal combustion engine, having a cycle, for each cylinder of the engine, including intake, compression, power, and exhaust strokes, the method comprising:

inserting two strokes into the cycle in addition to the intake, compression, power, and exhaust strokes:

wherein no material other than air is introduced into each cylinder during either of the additional two strokes; and wherein the two additional strokes occur at a time in the cycle for each cylinder after the end of the compression stroke, before combustion occurs, and before the power and exhaust strokes of the cycle.

2. The method of claim 1 wherein the two additional strokes create a more uniform composition within each cylinder, and wherein no material is introduced into the cylinder during the two additional strokes.

3. A method for improving the efficiency of an internal combustion engine having a cycle, for each cylinder of the engine, including intake, compression, power, and exhaust strokes, the method comprising:

inserting four strokes into the cycle in addition to the intake, compression, power, and exhaust strokes;

wherein no material other than air is introduced into each cylinder during either of the additional four strokes.

4. The method of claim 3 wherein two of the four additional strokes occur at a time in the cycle for each cylinder after the end of the exhaust stroke, and before the intake stroke of an immediately subsequent cycle; and wherein two others of the four additional strokes occur at a time in the cycle for each cylinder after the end of the compression stroke, before combustion occurs, and before the power and exhaust strokes of the cycle.

5. A method for improving the efficiency of an internal combustion engine, having a cycle, for each cylinder of the engine, including intake, compression, power, and exhaust strokes, the method comprising:

inserting two strokes into the cycle in addition to the intake, compression, power, and exhaust strokes, and inserting 2*N additional strokes into the cycle in addition to the intake, compression, power, and exhaust strokes, N being an integer;

wherein no material other than air is introduced into each cylinder during either of the additional two strokes;

wherein no material other than air is introduced into each cylinder during either of the additional 2N strokes; and wherein the additional 2N strokes occur at a time in the cycle for each cylinder immediately following the two additional strokes.

6. A high efficiency internal combustion engine system engine, having a cycle, for each cylinder of the engine, including intake, compression, power, and exhaust strokes, the system comprising:

a cylinder;

an air intake device;

a fuel injector;

an exhaust valve device;

a camshaft; and an electronic control unit (ECU) configured to control the operation of the air intake device, the fuel injector, the exhaust valve device and the camshaft, such that two strokes, in addition to the intake, compression, power, and exhaust strokes, are inserted into the cycle;

wherein no material other than air is introduced into each cylinder during either of the additional two strokes; and wherein the two additional strokes occur at a time in the cycle for each cylinder after the end of the compression stroke, before combustion occurs, and before the power and exhaust strokes of the cycle.

7. The system of claim 6, wherein the two additional strokes create a more uniform composition within each cylinder, and wherein no material is introduced into the cylinder during the two additional strokes.

* * * * *